US011433520B2

(12) United States Patent
Berning et al.

(10) Patent No.: US 11,433,520 B2
(45) **Date of Patent: *Sep. 6, 2022**

(54) TOOL FOR INSTALLING A BIT ON AND/OR DEINSTALLING A BIT FROM A BIT HOLDER SYSTEM OF A MILLING MACHINE

(71) Applicant: Wirtgen GmbH, Windhagen (DE)

(72) Inventors: Christian Berning, Zülpich (DE); Matthias Brück, Siegburg (DE); Lothar Schwalbach, Asbach (DE); Cyrus Barimani, Königswinter (DE)

(73) Assignee: Wirtgen GmbH

( * ) Notice: Subject to any disclaimer, the term of this patent is extended or adjusted under 35 U.S.C. 154(b) by 0 days.

This patent is subject to a terminal disclaimer.

(21) Appl. No.: 17/128,684

(22) Filed: Dec. 21, 2020

(65) Prior Publication Data

US 2021/0170557 A1 Jun. 10, 2021

Related U.S. Application Data

(63) Continuation of application No. 16/225,062, filed on Dec. 19, 2018, now Pat. No. 10,882,168.

(30) Foreign Application Priority Data

Dec. 20, 2017 (DE) ..... 10 2017 130 800.8

(51) Int. Cl.
*B25B 27/02* (2006.01)
*B25B 27/04* (2006.01)
(Continued)

(52) U.S. Cl.
CPC ..... *B25B 27/026* (2013.01); *B25B 23/14* (2013.01); *B25B 27/04* (2013.01); *E21C 35/18* (2013.01);
(Continued)

(58) Field of Classification Search
CPC ..... B25B 27/026; B25B 23/14; B25B 27/04; B25B 23/1422; B25B 27/02; E21C 35/18;
(Continued)

(56) References Cited

U.S. PATENT DOCUMENTS 4,742,470 A * 5/1988 Juengel ..... G05B 19/128 340/10.34
8,099,847 B2 1/2012 Hahn et al.
(Continued)

FOREIGN PATENT DOCUMENTS

DE 102007030640 B3 10/2008
DE 102008025071 A1 12/2009
DE 102016113251 A1 4/2017

*Primary Examiner* — Edwin C Holloway, III
(74) *Attorney, Agent, or Firm* — Gary L. Montle; Lucian Wayne Beavers; Patterson Intellectual Property Law, PC

(57) ABSTRACT

The invention relates to a tool for installing a bit on and/or deinstalling a bit from a bit holder system of a milling machine, in particular a road milling machine, having at least one initiator with which installation and/or deinstallation of a bit is initiated. Provision is made that the tool comprises a detection device having at least one counting device; and that the detection device is designed to detect a number of bits deinstalled using the tool and/or a number of bits installed using the tool. The invention also relates to a corresponding bit holder system and to a method for monitoring wear. With the tool and the bit holder system, additional information regarding bit changes that have been carried out is made available to a user.

20 Claims, 5 Drawing Sheets

(51) Int. Cl.

| | |
|---|---|
| ***B25B 23/14*** | (2006.01) |
| ***E21C 35/19*** | (2006.01) |
| ***E21C 35/18*** | (2006.01) |
| ***E01C 23/088*** | (2006.01) |
| ***G07C 5/08*** | (2006.01) |
| ***G07C 5/00*** | (2006.01) |

(52) U.S. Cl.
CPC ..... *E21C 35/19* (2013.01); *G07C 5/008* (2013.01); *G07C 5/085* (2013.01); *E01C 23/088* (2013.01); *E21C 35/188* (2020.05)

(58) Field of Classification Search
CPC .. E21C 35/19; E21C 25/10; E21C 2035/1826; E21C 35/188; G07C 5/008; G07C 5/085; E01C 23/088
USPC ..... 340/10.1
See application file for complete search history.

(56) References Cited

U.S. PATENT DOCUMENTS 8,181,322 B2 5/2012 Lehnert et al.
10,882,168 B2 * 1/2021 Berning ..... B25B 23/14
2003/0105599 A1 * 6/2003 Fisher ..... B25B 23/14 702/41
2003/0156401 A1 * 8/2003 Komine ..... G06K 19/04 361/815
2007/0132304 A1 * 6/2007 Holl ..... B28D 1/188 299/39.8
2008/0115636 A1 * 5/2008 DeRose ..... B25B 23/1425 81/479
2009/0019679 A1 1/2009 Hahn et al.
2009/0293249 A1 12/2009 Lehnert et al.
2010/0140345 A1 6/2010 Sakamoto et al.
2013/0035875 A1 * 2/2013 Hall ..... B02C 18/00 702/34
2013/0234494 A1 * 9/2013 Hall ..... E21C 35/18 299/29
2013/0273815 A1 * 10/2013 Schneider ..... B24B 13/0037 451/8
2015/0149027 A1 5/2015 Paulsen et al.
2015/0300165 A1 10/2015 Marsolek
2016/0168991 A1 * 6/2016 Von der Lippe ..... G01N 3/56 299/1.5
2017/0011564 A1 1/2017 Marsolek et al.
2017/0114637 A1 4/2017 Berning et al.
2017/0159432 A1 * 6/2017 Lavely ..... E21C 39/00
2018/0171568 A1 * 6/2018 Laclef ..... E01C 23/127

* cited by examiner

TOOL FOR INSTALLING A BIT ON AND/OR DEINSTALLING A BIT FROM A BIT HOLDER SYSTEM OF A MILLING MACHINE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of German Patent Application No. DE 10 2017 130 800.8, which was filed Dec. 20, 2017, and which is hereby incorporated by reference in its entirety.

FIELD OF THE INVENTION

The invention relates to a tool for installing a bit on and/or deinstalling a bit from a bit holder system of a milling machine, in particular a road milling machine, having at least one initiator with which installation and/or deinstallation of a bit is initiated.

The invention also relates to a bit holder system for a milling machine, in particular a road milling machine, having at least one bit receptacle for detachable fastening of at least one bit on a milling drum of the milling machine.

The invention also relates to a method for monitoring the wear of bits and/or of replaceable bit holders on bit holder systems of a milling drum of a milling machine, in particular a road milling machine, for replacement of the bits the bits being deinstalled from the bit holder systems with the aid of a tool, and/or the bits being installed on the bit holder systems with the aid of the tool, and the wear behavior of the bits and/or of the replaceable bit holders being determined on the basis of the number of bits replaced and/or the number of replaceable bit holders replaced.

BACKGROUND

Earth working machines that mill away the ground are used to remove earth material, for example for road repair or for surface mining. The earth working machines each have for that purpose a rotating milling drum on whose surface bits are arranged. The bits, constituting consumable parts, are replaceably connected to a milling drum tube of the milling drum. It is known for this purpose to fasten bit holder systems, by which the bits are detachably held, on the milling drum tube. The bit holder systems each comprise a bit holder for reception of the bits. Said holders can be directly connected to the milling drum tube, for example welded thereonto. It is also known to fasten a respective base mount onto the milling tube and to hold the bit holders detachably thereon. In a bit holder system of this kind comprising a base mount and a bit holder, a worn-out bit can be taken out of the bit holder and a worn-out bit holder can be removed from the base mount and substituted.

Separate tools for taking the bits out of the bit holders are known. One such tool is described in DE 10 2008 025 071 A1. A positioning member of the tool which carries a drift punch at its free end is held displaceably on a base part of the tool. The positioning member is coupled indirectly or directly to a piston-cylinder system or to an electric-motor unit which, after actuation of an initiator, pushes the terminal end of the drift punch against a support surface that constitutes the end-located termination of a bit shank held in the bit receptacle of the bit holder. The bit can be embodied as a round-shank bit, the bit shank being held in the bit receptacle, by means of a clamping sleeve, rotatably around its longitudinal axis but in axially immobilized fashion. The bit is pushed out of the bit holder by the pressure of the drift punch on the end of the bit shank. For that purpose, the tool is buttressed with its base part against the bit holder or against a wear protection washer arranged between a bit head and a projection of the bit holder.

DE 10 2007 030 640 B3 discloses a tool for installing and deinstalling a bit on a bit holder. The tool comprises a positioning member that can be displaced in two opposite directions by means of a positioning unit that is bidirectionally power-actuatable. A push-off portion, and a pull-in portion spaced away therefrom, are associated with the positioning member. The positioning member can be placed in an indentation on a base part of a bit holder by which a bit holder is held. It is also possible for the base part and the bit holder to be combined in one piece as a physical unit. In a pushing-out direction, the positioning member abuts with the push-off portion against a cylindrical supporting part that forms the termination, facing away from the bit head, of a bit shank of a round-shank bit. The pull-in portion encompasses the cylindrical supporting part and engages into a groove constituted between the cylindrical supporting part and the bit shank. A force in an ejection direction can thus be transferred to the bit by means of the push-off portion, while a force in a drawing-in direction of the bit can be introduced by engagement of the pulling-in portion into the groove. The positioning unit is hydraulically driven, and is coupled for that purpose to a battery-driven hydraulic unit. The positioning unit and the positioning member connected to it can be displaced by corresponding application of control, and a bit can thereby be ejected or drawn into the bit receptacle of the bit holder.

The document US 2015/0300165 A1 discloses a milling drum whose detachably fastened milling tools (bits) are each fitted with a transponder (RFID). The transponders contain data that enable unique identification of the respective milling tools. Associated with the milling machine is a reading device that reads out the information stored in the transponders and forwards it to a computer, which compares the received data with data stored in a memory. If the data are discrepant, it is assumed that a respective milling tool has been lost. A milling machine can thus determine, at any time, the number of milling tools present.

US 2017/0011564 A1 describes a monitoring system for bits of a milling drum. At least one transmitter, for example in the form of an RFID transmitter, is associated with each bit. The transmitter is in radio communication with a receiver arranged on the milling machine, and via that receiver with an evaluation system. If a signal of a transmitter is absent, the evaluation system recognizes the loss of, or impermissible wear on, a bit. For wear recognition, the at least one transmitter is arranged inside the bit or bit head. As wear on the bit advances, the transmitter becomes exposed and is destroyed.

DE 10 2016 113 251 A1 discloses a milling machine, a milling drum for such a milling machine, and a method for operating the milling machine. A means for determining a characteristic feature of the milling drum is associated with the milling machine. A value to be set, and/or a setting range, for at least one machine parameter of the milling machine is predefined on the basis of that characteristic feature. For example, the type of milling drum and thus the milling task can be determined on the basis of the characteristic feature. A characteristic feature can be defined, for example, by an identifier of the milling machine. Such an identifier can be stored in an active or passive transponder. The identifier or the transponder can be arranged in or on a milling drum tube, a tool holder, or a milling tool.

BRIEF SUMMARY

The object of the invention is to create a tool, for installing and/or deinstalling a bit on a bit holder of a bit holder system of a milling drum, which provides a user with improved information for ascertaining wear.

A further object of the invention is to furnish a corresponding bit holder system.

Another object of the invention is to furnish a method with which the wear behavior of bits and bit holders of a milling machine can be easily and reliably ascertained.

That object of the invention which relates to the tool is achieved by the fact that the tool comprises a detection device having at least one counting device; and that the detection device is designed to detect a number of bits deinstalled using the tool and/or a number of bits installed using the tool. The machine operator and/or the persons maintaining the milling machine thus know directly how many bits on a milling drum have been changed. Errors in determining the number of bits replaced, which can occur with simple counting by maintenance personnel, are thereby reliably avoided. Based on the number of bits deinstalled and/or installed, the machine operator can draw conclusions as to the wear behavior of the bits in the context of the milling task that has been carried out. This makes possible a prognosis regarding future wear behavior as the milling task is continued. From that prognosis it is possible to infer, for example, the bits required until the milling task is completed, or a suitable duration for the maintenance intervals. The numbers regarding replaced bits can be used to manage the spare parts inventory and the bits supplied to a construction site and kept in stock at the site. Based on the bit changes required, conclusions can be drawn as to the material properties of the substrate being milled. The machine parameters can then, for example, be adapted in such a way that the greatest possible milling output, simultaneously with minimum wear, is achieved. This allows the milling machine to be operated economically. In consideration of the detected number of exchanged bits, the machine utilization efficiency, and costs for machine utilization for a completed milling job, can be determined. Advantageously, the detection device is arranged on the tool with which the bits are inserted and removed. This is advantageous as compared with known detection devices arranged on the milling machine in the immediate vicinity of the milling drum, since the detection device is not exposed to the large mechanical stresses that occur during the milling process. The bits are held by bit holder systems that are mounted on a milling drum tube of the milling machine. A respective bit holder system comprises for that purpose a corresponding bit holder that encompasses, for example, a bit receptacle for receiving and detachably securing a bit shank. The tool is embodied to introduce the bit with its bit shank into the bit receptacle of the bit holder and/or to drive it out thereof. The bit holder can be secured directly on the milling drum tube. It then constitutes the bit holder system. Provision can also be made that a replaceable bit holder is held detachably by a base carrier, the base carrier being connected fixedly to the milling drum tube, for example via a welded join. The bit holder system is then constituted by the replaceable bit holder and the base carrier.

Simple and reliable detection of the inserted and/or removed bit can be accomplished by the fact that the detection device is configured, upon actuation of the at least one initiator, to increment by one a count status of the counting device for the number of deinstalled bits or for the number of installed bits. Actuation of the initiator represents a unique signal that is easy to detect and can be uniquely associated with an inserted and/or removed bit.

In accordance with a preferred variant embodiment of the invention, provision can be made that the detection device is embodied, upon actuation of the at least one initiator, to read out at least one identifier arranged on the bit holder system onto which the tool is placed; and/or that the detection device is embodied, upon actuation of the at least one initiator, to read out at least one identifier that is arranged on the bit held by the bit holder system onto which the tool is placed. The identifier makes possible unique identification of a respective bit holder system or bit. The identifier can contain further data, for example a bit type, an item number of the bit or bit holder system, and/or an installation date or installation time of the bit or bit holder system.

Alternatively to incrementing of the counter upon actuation of the initiator, an incrementing of the counter can also occur upon detection of an identifier. These alternatives are also intended to apply to all exemplifying embodiments hereinafter.

According to a possible inventive variant, provision can be made that the detection device is embodied to read out a data medium, in particular an electronic data medium, arranged as an identifier on the bit holder system. An electronic data medium allows almost any data to be stored. Those data can contain information that enables unique identification of a respective bit holder system and thus of a bit. Instead of the electronic data medium it is also conceivable to provide another form of identifier, for example in the form of an optically readable data medium. An optically readable data medium can be, for example, a barcode. A barcode of this kind can be arranged inexpensively on the bit holder system. Any form of machine-readable identification is suitable in principle as an identifier for the bit holder system.

If provision is made that the detection device is embodied to read out the identifier in noncontact fashion, no mechanical or electrical connection between the tool and the identifier is then necessary for the transfer of data from the identifier to the detection device. The tool can thus be embodied in accordance with known tools, and can merely have the detection device added to it. Retrofitting of existing tools with a detection device according to the present invention is also conceivable.

In accordance with a particularly preferred variant embodiment of the invention, provision can be made that the detection device is embodied, upon actuation of the at least one initiator, to detect a position on a milling drum of the bit holder system onto which the tool is placed. The position of the bit holder system can be stored, for example, in the identifier and correspondingly read out. The position of the bit holder system can contain a coordinate proceeding in an axial direction of the milling drum and/or a coordinate proceeding in a circumferential direction of the milling drum, for example in the form of an angle indication. The coordinate proceeding in a circumferential direction can be referred, for example, to a previously specified zero line. The zero line then corresponds, for example, to a line proceeding on the circumference of the milling drum tube in the direction of its rotation axis. It is also conceivable to associate with each possible installation position of the bit holder system a unique position number that enables unique identification of the position of a respective bit holder system on the milling drum.

Provision can advantageously be made that the detection device comprises an RFID reading device. An RFID transponder is then associated as an identifier with each of the bit holder systems. RFID transponders are available inexpensively in large quantities, and data that make possible unique identification of a bit holder system can be stored in them. Data that characterize the position of the respective bit holder system on the milling drum can also be stored in them. The RFID transponders can be embodied as active or passive RFID transponders. Passive RFID transponders have the advantage that they do not require their own energy supply. The RFID reading device allows the data of the RFID transponder to be read out in noncontact fashion, i.e. without establishing an electrical or mechanical contact. The result is a simple and inexpensive design for the tool.

Rapid and simple deinstallation and/or installation of the bits can be achieved by the fact that the tool comprises a base part on which a positioning member having a push-off portion and/or having a pull-on portion is movably mounted; and that the positioning member is indirectly or directly coupled onto an actuator. The actuator can be constituted, for example, by a piston-cylinder system or by an electric-motor unit. The push-off portion can be embodied in the form of a drift punch. The push-off portion allows a bit to be driven out of a bit holder. With the aid of the pull-in portion, a bit can be pulled with its bit shank into a bit receptacle of the bit holder. The base part allows the tool to be secured on the bit holder system. The actuator is initiated by actuating the at least one initiator. At the same time, the count status of the counting device for deinstalled and/or installed bits is incremented as a result of the actuation of the at least one initiator. If the tool is designed, for example, for both installation and deinstallation of bits, two initiators can correspondingly be provided, one initiating an installation motion and the second a deinstallation motion of the positioning member. The count status of the counting device for an installed or for a deinstalled bit is then incremented, depending on which of the initiators was actuated. It is conceivable to provide two counting devices, one of which counts the installed bits and one the deinstalled bits. It is thereby possible, for example, to recognize whether all the driven-out bits have been substituted with new ones in the context of a bit change. It is also conceivable to use only one initiator, the functionality of which is switchable between initiating an installation and a deinstallation, or which alternatively initiates installation and deinstallation. Upon actuation of the initiator the count status for deinstalled bits or for installed bits is then incremented, depending on the functionality selected.

Particularly advantageously, provision can be made that at least a part of the detection device, in particular the RFID reading device, is arranged on or in the positioning member or on or in the base part of the tool. That portion of the detection device which is responsible for detecting the identifier, for example the RFID reading device, can thereby be brought into the immediate vicinity of an identifier arranged on the bit holder system, in particular of an RFID transponder arranged on the bit holder, upon installation or deinstallation of a bit. This makes possible unimpeded data exchange between the RFID transponder and the RFID reading device. The data read out from the RFID transponder make possible, for example, the above-described determination of the position of the bit holder system on the milling drum. A bit change can thus be associated with a specific bit holder system and with a position on the milling drum.

To prevent an erroneous actuation of the at least one initiator, during which deinstallation and/or installation of a bit does not occur, from resulting in a change in the determined number of deinstalled and/or installed bits, provision can be made that the detection device is embodied to recognize an actuation of the at least one initiator without occurrence in that context of installation or deinstallation of a bit, and then not to modify the number of detected installed and/or installed bits; and/or that the detection device is embodied not to modify the number of detected installed and/or deinstalled bits upon a repeated actuation of the at least one initiator within a predefined time period; and/or that the detection device is embodied not to modify the number of detected installed and/or deinstalled bits upon a readout of the same identifier repeated within a predefined second time period; and/or that the detection device is embodied not to modify the number of detected installed and/or deinstalled bits upon an actuation of the at least one initiator and in the absence of readout of an identifier. For example, if two successive initiating operations occur within a predefined time period that is selected to be sufficiently short that deinstallation and/or installation of two bits is not possible within the time period, the count status is correspondingly not modified. If an initiating operation is repeatedly carried out successively on the same bit holder system, this can then be recognized based on the fact that the same identifier is read out successively. In this case as well, the count status of the deinstalled and/or installed bit is correspondingly not modified. If no identifier is read out upon initiation of the tool, it can be assumed that the tool is not placed onto a bit holder system and thus that a bit was not deinstalled or installed. In that case as well, no modification of the count status of the counting unit occurs. It is also conceivable for the tool to be embodied to detect the force applied by the tool. The detection device can then be embodied to infer, based on the information regarding the applied force, whether installation or deinstallation of a bit has occurred.

The bit holder system can be embodied in two parts, namely from a base part connected to the milling drum and a replaceable bit holder held therein. Provision is made that the detection device is designed to read out an identifier arranged on a base carrier of the bit holder system and/or an identifier arranged on a replaceable bit holder associated with the base carrier, so that an association of a replaceable bit holder with a base carrier can be detected and checked by the detection device or by a control unit to which the detection device transfers the data. If what is ascertained for a base carrier upon detection of an identifier of a bit holder and a base carrier is, for example, a bit holder different from the one stored for it in the detection device or in the control unit, it can be inferred that the bit holder has been changed. The tool thus also makes possible recognition and detection of changed bit holders.

To allow recognition of a replaced bit holder, provision can also be made that the detection device is embodied, upon actuation of the at least one initiator, to read out the at least one identifier arranged on a bit holder system and to detect the position of the bit holder system on the milling drum; and that the detection device is embodied to detect, by comparing the data read out from the identifier with data stored in the detection device for the position on the milling drum, that a replaceable bit holder at that position has been changed. The identifier is preferably arranged on the replaceable bit holder of the bit holder system.

Advantageously, provision can be made that the detection device comprises a memory and that the data read out from the identifiers, and/or the points in time at which the respective identifiers were read out, are storable in the memory; and/or that the stored data and/or points in time are associated with a count status of the counting device. The data, together with the count status, can thus be stored and transferred to a higher-order control unit. The transfer can be accomplished, for example, once all the worn-out bits of a milling drum have been replaced.

A preferred variant embodiment of the invention provides that the tool comprises a wire-based interface or a radio interface for electronic transfer of data. The interface is connected to the detection device or is part of the detection device. Data can be transferred from the detection device to a control unit, and conversely from a control unit to the detection device, via the interface. It is thereby possible to transfer to the control unit the number of deinstalled and/or installed bits detected by the tool. Said unit can be arranged, for example, in the milling machine. The control unit can then indicate to the machine operator, via an indicator, the number of deinstalled or installed bits. The tool therefore does not need to have its own indicator for displaying the number of exchanged bits. Further data transferred from the identifiers to the tool, for example position data, or data derived therefrom, can also be transferred via the interface to the control unit and evaluated or displayed by it.

In order also to allow data to be transferred to the identifiers arranged on the bit holder systems, provision can be made that the tool and/or the detection device comprises a data interface; and that the data interface is embodied to transfer data to the data medium arranged as an identifier on the bit holder system. It is thereby possible, for example, to transfer a point in time at which a bit was installed on the bit holder system. That can then be read out again upon deinstallation of the bit, and used to determine the service life of the bit. In addition, the data necessary for identification of the respectively associated bit holder system can be transferred from the tool to the identifiers prior to a first use of the identifiers. There is thus no need for further devices that allow writing to the identifiers.

That object of the invention which relates to the bit holder system is achieved in that at least one electronic data medium that can be read out in noncontact fashion is arranged as an identifier on or in the bit holder system; and that the data medium contains information for identification of the bit holder system and/or regarding the position of the bit holder system on the milling drum. Reading out the data media of the bit holder systems arranged on a milling drum allows each of said systems to be uniquely identified, and/or it is possible to determine the position of a particular bit holder system on the milling drum. It is thereby possible, in the context of a bit change, to associate the changed bit with a specific bit holder system and/or with a position on the milling drum. It is thereby possible, for example, to ascertain how often a bit on a specific bit holder system has been changed. When referred to a milling operation carried out by the milling drum, conclusions can then be drawn, from the data thereby obtained, as to the wear behavior of the bits at their respective installation locations on the milling drum. From the wear behavior, prognoses can be created for the future demand for bits as the milling task is continued. Conclusions can be drawn as to the material properties of the milled substrate. Based on this information it becomes possible, for example, to adjust the machine parameters of the milling machine in optimized fashion in such a way that maximum possible milling performance is achieved with minimum wear on the bits. Machine utilization efficiency can thereby be increased, and costs for machine utilization thereby reduced. Advantageously, the data media are arranged not in or on the bits, but in or on the bit holder systems. A data medium is thus not also replaced when a bit change is required, but can instead be used in accordance with the service life of the bit holder system. The number of data media required for monitoring the replacement of and wear on bits can thereby be significantly reduced as compared with known systems in which the data media are arranged in or on the bits.

A long life expectancy for the data media can be achieved by the fact that the data medium is arranged in a region of the bit holder system which is protected from abrasion.

In accordance with a particularly preferred variant embodiment of the invention, provision can be made that the data medium is an active or passive RFID transponder. RFID transponders are offered inexpensively in large quantities, and data that make possible unique identification of a bit holder system, or of its position on a milling drum, can be stored in them. It is also possible to provide RFID transponders that make it possible to modify the stored data later. Passive RFID transponders furthermore have the advantage that they do not require a separate power supply.

Provision can advantageously be made that the data medium contains information regarding the point in time at which a bit held in the bit holder system was installed. Upon removal of a bit that has reached the wear limit, the service life of the bit under the past operating conditions of the milling drum and milling machine can thus be identified.

Provision can be made that the bit holder system comprises a bit holder connected fixedly to the milling drum, and that the at least one data medium is arranged on or in the bit holder; or that the bit holder system comprises a base carrier connected fixedly to the milling drum and a replaceable bit holder detachably connected to the base carrier, and that at least one data medium is arranged on or in the base carrier and/or on or in the replaceable bit holder. In the case of a bit holder connected fixedly to the milling drum, for example by way of a welded join, the position data of the bit holder system can be uniquely associated with the bit holder and stored in the data medium arranged on or in the bit holder. In the case of a two-part bit holder system with which a base carrier and a bit holder, connected replaceably thereto, are associated, the position data on the milling drum can be uniquely associated with the base carrier fixedly connected to the milling drum, and thus stored in a data medium arranged on the base carrier. A replaceable bit holder can firstly be installed on any base carrier. If both the replaceable bit holder and the base carrier in which the bit holder is held comprise a data medium, a unique association between a base carrier and a replaceable bit holder installed thereon can then be established based on the stored data. The position of the replaceable bit holder on the milling drum can thus also be uniquely determined by way of that association. Upon replacement of the bit holder, for example because of advanced wear, a new bit holder having a new identifier is associated with the base carrier, this being recognized when the data media arranged on the base carrier and on the replaceable bit holder are read out. Replacement of a bit holder can thereby be verified and detected. Based on the number of replaced bit holders thereby ascertained, it is possible to infer their service life under the past operating conditions of the milling drum and the milling machine. This allows a prognosis as to the future demand for bit holders in order to continue the milling task.

That object of the invention which relates to the method is achieved in that the number of bits installed and/or deinstalled using the tool is detected by a detection device arranged on the tool; and/or that the position of a bit installed and/or deinstalled using the tool is detected by the detection device arranged on the tool; and/or that the position and a unique identification of a bit holder system on which a bit is deinstalled or installed is detected by the detection device. The number of bits replaced, and thus their wear behavior, can be inferred directly from the number of bit installed and/or deinstalled. Further parameters, for example a utilization duration of the bits, can also be considered. It is also possible to take into consideration the machine parameters that are provided in the context of the milling jobs carried out and which the milling machine was operated, or to consider the material being milled. If the position of the bits or bit holders on the milling drum is also detected, spatially resolved wear monitoring can then be accomplished. It is thereby possible, for example, to evaluate whether elevated wear exists in certain regions of the milling drum. A change of a replaceable bit holder can be inferred if, in a context of successive bit changes at one position of the milling drum, a bit holder system having a different identification is detected.

Simple and reliable determination of the position of a replaced bit or of a replaced replaceable bit holder on the milling drum can be accomplished by the fact that the position of a deinstalled and/or installed bit, and/or the position of a replaceable bit holder on which a bit is deinstalled and/or installed, is detected by reading out an identifier arranged on the bit holder system. The detection unit arranged on the tool preferably comprises means with which the identifier can be read out automatically.

BRIEF DESCRIPTION OF THE SEVERAL VIEWS OF THE DRAWINGS

The invention will be explained in further detail below with reference to an exemplifying embodiment depicted in the drawings, in which.

DETAILED DESCRIPTION

Figure 1:
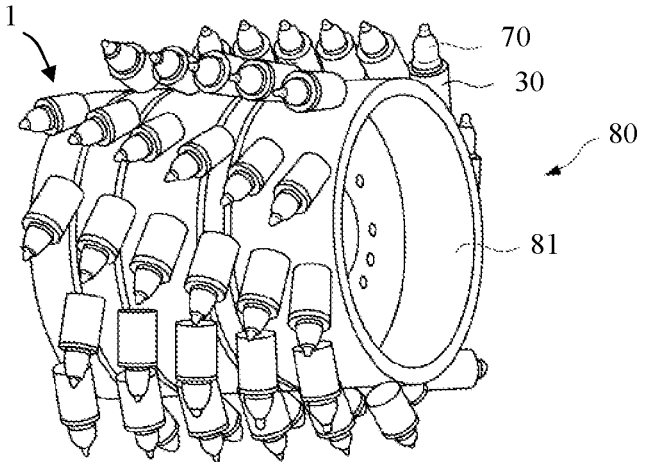
FIG. 1 is a perspective side view of a milling drum having bit holders fastened thereon.
Figure 3:
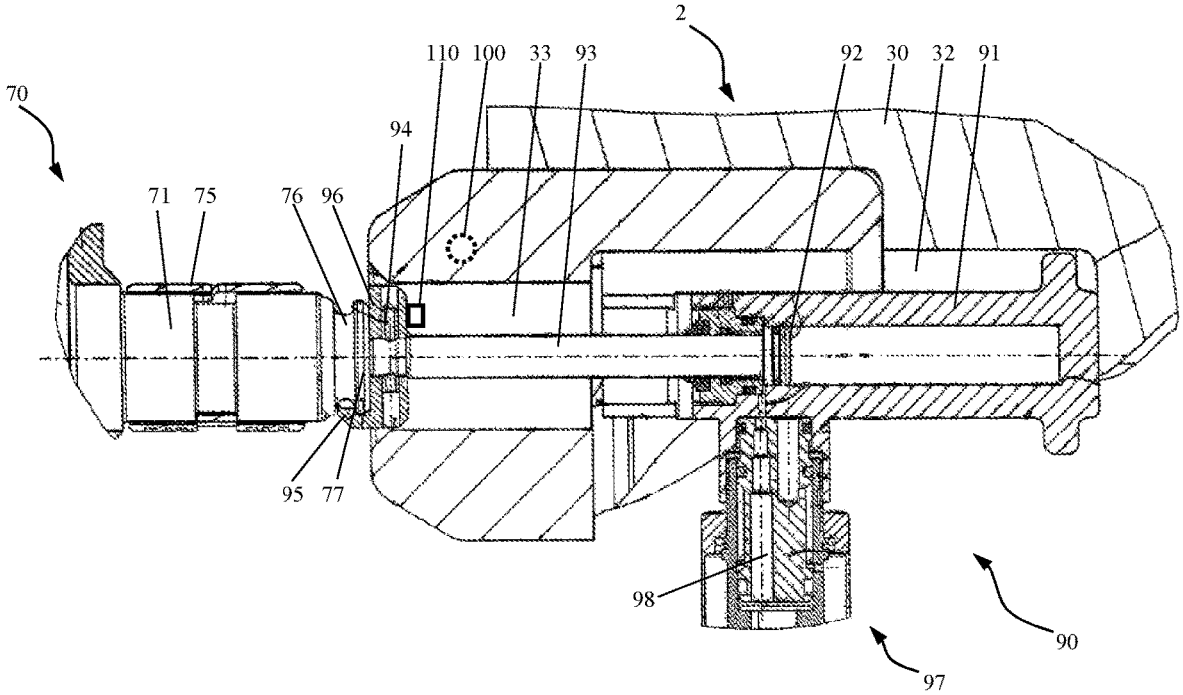
FIG. 3 is a sectioned side view of the one-piece bit holder system shown in FIG. 2, having a first tool set in place.
Figure 5:
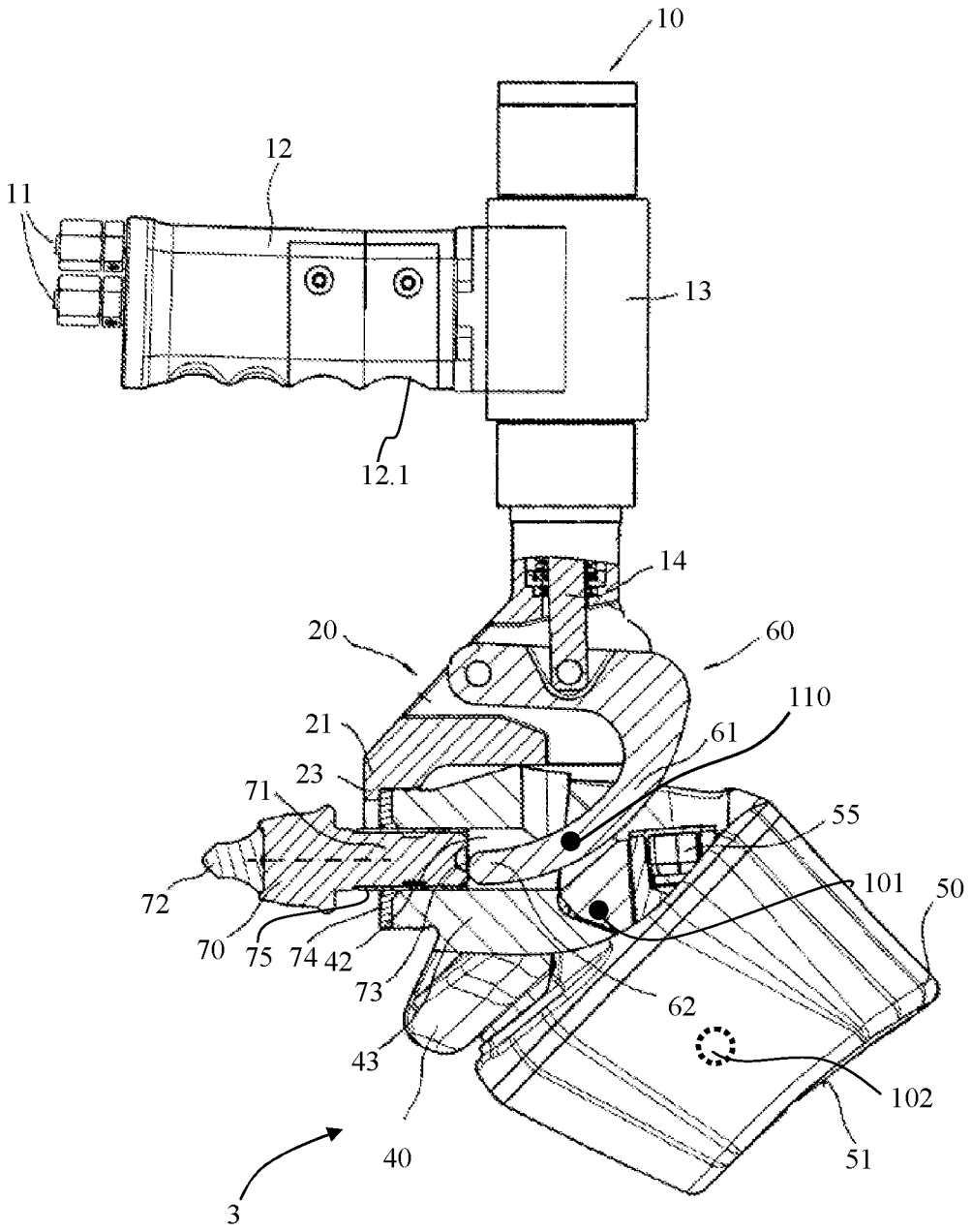
FIG. 5 is a partly sectioned side view of the two-part bit holder system as shown in FIG. 4, having a second tool set in place.

FIG. 1 is a perspective side view of a milling drum 80 of a milling machine (not depicted), having bit holders 30 fastened thereonto. Bit holders 30 are fastened onto the outer circumference of a milling drum tube 81 of milling drum 80. They each constitute a bit holder system 1. In the exemplifying embodiment shown, bit holders 30 are connected directly to milling drum tube 81. Bit holders 30 are welded onto milling drum tube 81 for that purpose. Bits 70 are held in bit holders 30. Bits 70 are embodied in the present instance as round-shank bits. They are held in bit holders 30, each with a bit shank 71 that is shown in FIGS. 3 and 5, rotatably around their longitudinal axis but in axially immobilized fashion.

Different milling drums 80 having different arrangements of bit holders 30, and having bits 70 adapted to the respective milling task, are used depending on the milling task to be carried out.

Bits 70 are subjected to severe wear and must therefore be regularly replaced. Their service life depends on the material properties of the substrate being worked, and on the machine parameters with which the milling machine, and thus the milling drum, is operated.

For replacement of bits 70, they can be detached from bit holders 30 and new bits 70 can be inserted into bit holders 30. Special tools 10, 90 are used for this, as shown by way of example in FIGS. 3 and 5.

Figure 2:
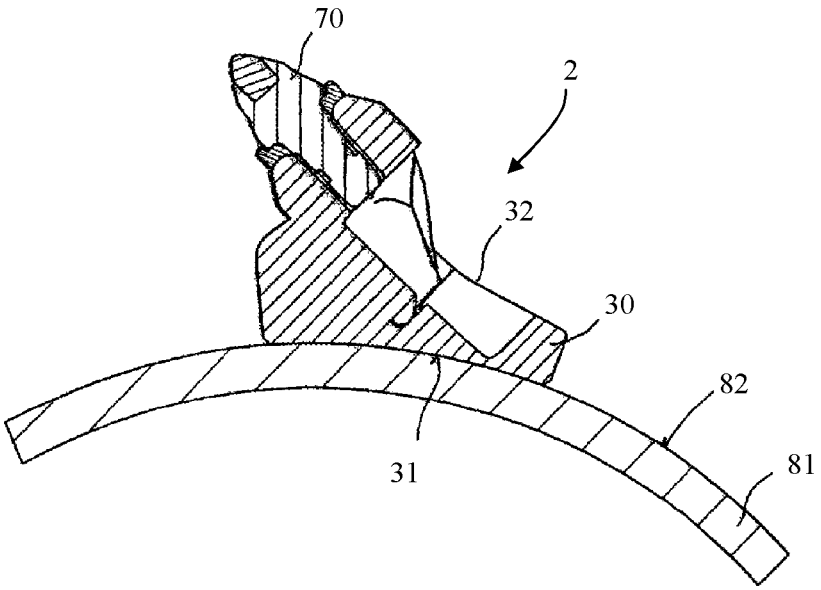
FIG. 2 is a schematic sectioned side view of a one-piece bit holder having an inserted bit.

FIG. 2 is a schematic sectioned side view of a one-piece bit holder system 2 having a bit 70 inserted. Bit holder 30 is set, with a concavely embodied abutment portion 31, onto a drum surface 82 of milling drum tube 81 and welded to it. It has an indentation 32 facing away from milling drum tube 81.

FIG. 3 is a sectioned side view of the one-piece bit holder system 2 shown in FIG. 2, having a first tool 90 set in place. First tool 90 is inserted with a first base part 91 into indentation 32 of bit holder 30. First base part 91 constitutes a cylinder in which a piston 92 is guided. Piston 92 is connected via a first piston rod 93 to a first positioning member 94. First positioning member 94 forms a hook-shaped pull-in portion 95 and a first push-off portion 96. A first handle 97 is connected to first base part 91. First handle 97 carries a hydraulic unit 98 that can have control applied to it via an initiator 12.1 shown in FIG. 5 for a second tool 10. Hydraulic unit 98 allows pressure to be applied to piston 92 selectably on its oppositely located surfaces. First positioning member 94 is thus bidirectionally force-actuatable. In the extended position that is shown, first positioning member 94 has been inserted into a first bit receptacle 33 of bit holder 30 as far as an outer end of said receptacle.

Bit 70 comprises a cylindrical bit shank 71 around which a clamping sleeve 75 is arranged. A circumferential pull-in groove 76 is shaped into bit shank 71 in its free end region. Bit shank 71 forms a cylindrical support part 77 at the end.

First positioning member 94 abuts with its first push-off portion 96 against cylindrical support part 77 and thus against the free end of bit shank 71. It engages with its pull-off portion 95 into pull-in groove 76. By means of a corresponding application of pressure to piston 92, first positioning member 94 is displaced toward first base part 91 and thus into first bit receptacle 33. As a result of the engagement of pull-in portion 95 into pull-in groove 76, bit shank 71 is pulled into first bit receptacle 33 and held there with clamping sleeve 75. Bit 70 is thereby installed on bit holder 30, and first tool 90 can be removed from indentation 32. For deinstallation of bit 70, first tool 90 is again placed with its first base part 91 into indentation 32, and first positioning member 94 is pushed into first bit receptacle 33 by a corresponding application of pressure to piston 92. First positioning member 94 pushes with its first push-off portion 96 against cylindrical support part 77 of bit shank 71, with the result that bit 70 is driven out.

A detection device 110 is arranged on first tool 90. Detection device 110 is depicted symbolically by a rectangle. Associated with detection device 110 are two counting devices 113, one of which is shown schematically in FIG. 6. Detection device 110 is designed to detect a number of bits 70 deinstalled using first tool 90, and a number of bits 70 installed using first tool 90. For this, the count status of first counting device 113 is incremented with each bit 70 that is deinstalled, and the count status of second counting device 113 is incremented with each bit 70 that is installed. Also associated with first tool 90, outside the selected image portion and thus not depicted, are two initiators 12.1, one of which initiates an installation motion and one a deinstallation motion of first positioning member 94. The count status of counting device 113 that counts deinstalled bits 70 is incremented upon actuation of initiator 12.1 that initiates the deinstallation motion. Correspondingly, the count status of counting device 113 that counts the installed bits is incremented upon actuation of initiator 12.1 that initiates the installation motion. The wear behavior of bits 70 for the milling task being carried out can be ascertained on the basis of the number of replaced bits 70 which is thereby detected.

In the exemplifying embodiment shown, detection device 110 is fastened to first positioning member 94 of first tool 90.

It is also conceivable, however, to arrange detection device 110 on other components of first tool 90, for example on first base part 91 or in first handle 97.

Figure 6:
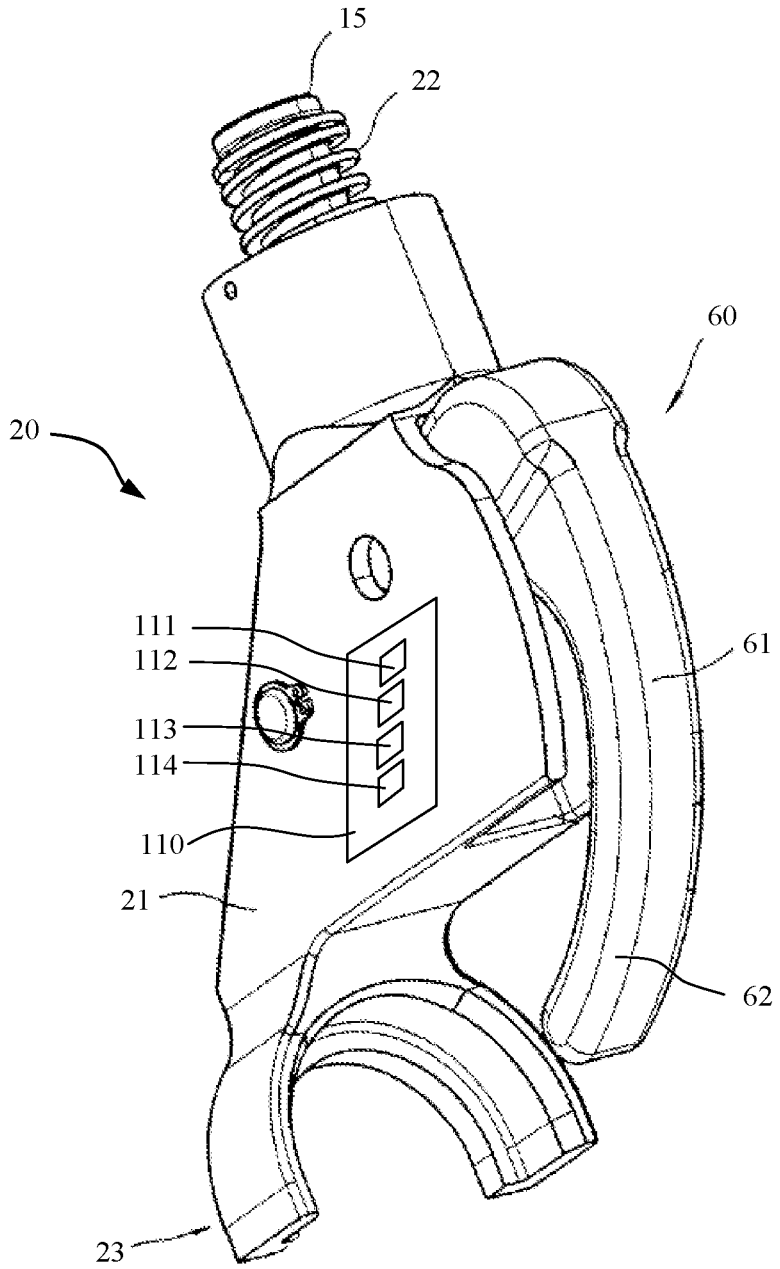
FIG. 6 is a perspective depiction of an adapter of the second tool as shown in FIG. 5.

Individual subassemblies of detection device 110 can also, as shown by way of example in FIG. 6, be arranged on various components of first tool 90 and connected, preferably electrically, to one another. For example, it is conceivable to arrange counting devices 113 in first handle 97. An optionally possible readout unit can then advantageously be arranged on first positioning member 94. It can also be provided, however, on other components of first tool 90, for example on piston rod 93 or on first base part 91. If at all possible, the readout unit is arranged on first tool 90 so that it is located close to the identifier when first tool is placed onto second tool holder system 2. In the present case, the readout unit is embodied as an RFID reading device 111, as shown schematically in FIG. 6.

A likewise optionally possible identifier is arranged on the one-piece bit holder system 2 and thus on bit holder 30. The identifier is embodied in the present case as a first RFID transponder 100. First RFID transponder 100 is depicted schematically in the illustration as a dotted-line circle. Data of the (in the present case, one-piece) bit holder system 2 are stored in the identifier. When first RFID transponder 100, as shown, is the identifier, the data are stored electronically. Other forms of identifiers can also be used, however, for example an optically readable identifier. One such optically readable identifier can be, for example, a barcode that is arranged on the one-piece bit holder system 2.

The identifier can be read out with the aid of the readout unit of detection device 110, in the present case using an RFID reading device. The data contained in the identifier contain information that makes possible a unique identification of first bit holder system 2. Based on the data read out, a bit change can be uniquely associated with a specific first bit holder system 2 of milling drum 80. It is thereby possible to ascertain how many bit changes have been performed on a specific first bit holder system 2. Conclusions can be drawn therefrom as to the wear behavior of bits 70 on a specific first bit holder system 2. Provision is made here that the data stored in the identifier characterize a position of first bit holder system 2 on milling drum 80. The wear behavior of bits 70 can thereby be determined in spatially resolved fashion over milling drum 80.

Figure 4:
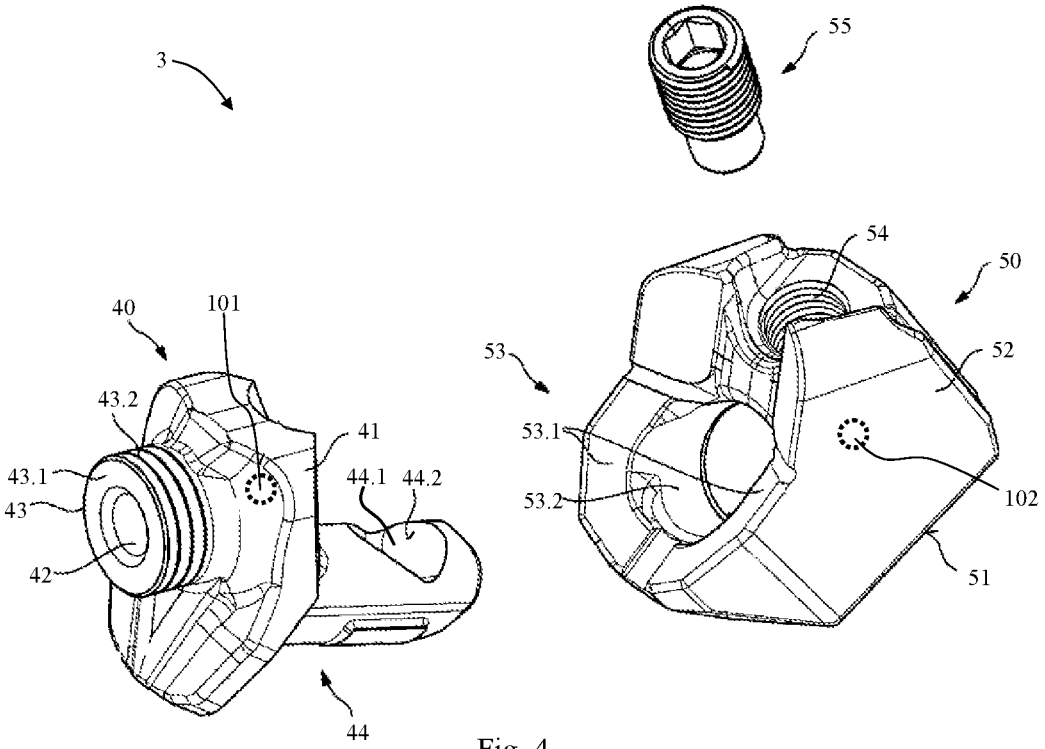
FIG. 4 is an exploded perspective view of a bit holder system embodied in two parts.

FIG. 4 is an exploded perspective depiction of a bit holder system 3 embodied in two parts. A base carrier 50 and a replaceable bit holder 40 are associated with the two-part bit holder system 3. Base carrier 50 can be placed with a lower attachment side 51 onto a milling drum tube 81 shown in FIG. 1, and welded to it. Base carrier 50 is thus connected in stationary and permanent fashion to milling drum tube 81. Base carrier 50 comprises a basic body 52 into which an insertion receptacle 53.2 is shaped as an opening. Support surfaces 53.1 are arranged on basic body 52 alongside insertion receptacle 53.2 and facing toward replaceable bit holder 40. Support surfaces 53.1, together with insertion receptacle 53.2, form a bit holder receptacle 53. Alongside bit holder receptacle 53, a threaded receptacle 54 is shaped into basic body 52 of base carrier 50. Threaded receptacle 54 constitutes an opening to insertion receptacle 53.2. A compression bolt 55 can be screwed into threaded receptacle 54.

Replaceable bit holder 40 comprises a support body 41. An insertion projection 44 is shaped onto support body 41. In the installation orientation shown, insertion projection 44 is oriented toward insertion receptacle 53.2 of base carrier 50. It comprises a compression bolt receptacle 44.1 that is closed off by a compression surface 44.2 oriented obliquely with respect to the longitudinal extent of insertion projection 44. Opposite insertion projection 44 and laterally offset from it, a holding portion 43 is connected integrally to support body 41. Holding portion 43 is embodied cylindrically. It comprises a second bit receptacle 42 proceeding along its longitudinal center axis. Second bit receptacle 42 is embodied as an orifice guided through holding portion 43 and through support body 41. Facing away from support body 41, holding portion 43 is closed off by a wear surface 43.1. Wear markings 43.1 are shaped into the surface of holding portion 43 on the outer periphery of holding portion 43 at various distances from wear surface 43.1.

For fastening of replaceable bit holder 40 onto base carrier 50, insertion projection 44 of bit holder 40 is slid into insertion receptacle 53.2 of base carrier 50 until support body 41 abuts with correspondingly shaped counterpart surfaces against support surfaces 53.1 of base carrier 50. In this position, compression surface 44.2 of insertion projection 44 is arranged in alignment with threaded receptacle 54 of base carrier 50. When compression bolt 55 is screwed into threaded receptacle 54, it presses at the end against compression surface 44.2. Insertion projection 44 is thereby secured in insertion receptacle 53.2. For deinstallation of replaceable bit holder 40, compression bolt 55 is unscrewed with the result that insertion projection 44 and thus replaceable bit holder 40 are released.

According to the present invention an identifier, in the present case in the form of a second RFID transponder 101, is arranged in or on replaceable bit holder 40. Second RFID transponder 101 is depicted schematically by a dashed-line circle. In the present case, second RFID transponder 101 is positioned in a recess (not shown) in support body 41 of replaceable bit holder 40. It is also conceivable, however, to arrange second RFID transponder 101 in or on holding portion 43 or in or on insertion projection 44.

A further identifier, in the present case constituting a third RFID transponder 102, is arranged on base carrier 50. It too is symbolically depicted by a dashed-line circle. Third RFID transponder 102 is arranged in the present case in a recess (not depicted) in basic body 52 of base carrier 50. It is also conceivable, however, to fasten third RFID transponder 102 onto a protected region of the surface of base carrier 50.

Second and third RFID transponders 101, 102 thus constitute identifiers of the two-part bit holder system 3, here of replaceable bit holder 40 and of base carrier 50. It is also conceivable to provide only one identifier, for example on replaceable bit holder 40 or on base carrier 50. Data can be stored in the identifiers. The data can be read out via a corresponding readout unit, in the present case a corresponding RFID reading device 111 as depicted schematically in FIG. 6.

RFID transponders 100, 101, 102 shown in FIGS. 3 to 5 represent electronic data media that can be read out in noncontact fashion. They are embodied in the present case as passive RFID transponders 100, 101, 102. These have the advantage that they do not require their own energy supply. The energy necessary for reading out the stored data is taken from the radio signal of RFID reading device 111.

The data stored in the identifiers shown in FIG. 4 (second and third RFID transponders 101, 102) make possible a unique identification of base carrier 50 and of replaceable bit holder 40. By reading out the data it is thus possible to associate a specific replaceable bit holder 40 with a base carrier 50. When a replaceable bit holder 40 is exchanged, a new replaceable bit holder 40 having a new identifier is then associated with base carrier 50. This can be recognized by reading out the data of second and third RFID transponders 101, 102. By reading out the identifiers of base carrier 50, and of the particular replaceable bit holder 40 installed therein, of a milling drum 80, it is therefore possible to determine the number of replaced bit holders 40. Data that characterize the position of base carrier 50 on milling drum 80 are stored in third RFID transponder 102 associated with base carrier 50. Those data can contain a coordinate oriented in a circumferential direction of milling drum 80, for example in the form of an angle indication, and a coordinate proceeding in the direction of the longitudinal extent of milling drum 80. It is also conceivable to associate a position number with each possible position of a base carrier 50 on milling drum 80, and to store that number in second RFID transponder 101. The position of the associated base carrier 50 on milling drum 80 can thus be uniquely determined by reading out third RFID transponder 102. Changes of replaceable bit holders 40 can thereby be ascertained in accurately positioned fashion. It is thereby possible to ascertain, for example, if replaceable bit holder 40 on a base carrier 50 has been replaced several times.

Be it noted once again at this juncture that according to the present invention other identifiers, for example optically readable identifiers, e.g. barcodes, can also be used instead of RFID transponders 100, 101, 102 that are shown. The readout unit is then suitably embodied to read out the identifiers that are used.

FIG. 5 is a partly sectioned side view of the two-part bit holder system 3 shown in FIG. 4, having a second tool 10 set in place. Base carrier 50 is abutted with its lower attachment side 51 against a milling drum tube 81 (not shown) and welded to it. Insertion projection 44 of replaceable bit holder is inserted into the associated insertion receptacle 53.2 of base carrier 50 and held therein by compression bolt 55. A bit 70 is inserted with its bit shank 71 partly into second bit receptacle 42 of replaceable bit holder 40. A clamping sleeve 75 is provided circumferentially around bit shank 71. Said sleeve presses against the wall of second bit receptacle 42 and engages into a groove shaped circumferentially into bit shank 71. Bit 70 is thereby held in second bit receptacle 42 rotatably but in axially immobilized fashion. A bit tip 72, preferably made of a hard material, is fastened onto a bit head of bit 70 oppositely from bit shank 71. A wear protection washer 74 is arranged between a bit head and holding portion 43 of replaceable bit holder 40. The free end of bit shank 71 constitutes a support surface 73.

Second tool 10 comprises a second handle 12. An initiator 12.1 is arranged on second handle 12. Electrical contacts 11 are led out of the end of second handle 12. Oppositely from electrical contacts 11, second grip 12 is connected to a cylinder 13. Cylinder 13 is part of a piston-cylinder system that constitutes an actuator for driving a second positioning member 60. It is conceivable to use other actuators instead of the piston-cylinder system, for example electric motor-driven actuators. The piston-cylinder system is connected articulatedly to second positioning member 60 via a second piston rod 14. At a distance from the attachment point of second piston rod 14, second positioning member 60 is mounted pivotably on a second base part 21 of an adapter 20. Second base part 21 of adapter 20 is abutted against replaceable bit holder 40 and held in its position by a push-off part 23 that braces against wear protection washer 74. Second positioning member 60 is embodied in the form of a curved lever 61. The free end of second positioning member 60 forms a second push-off portion 62 in the form of a drift punch 62, which is introduced through a rear-side access into second bit receptacle 42 of replaceable bit holder 40. Second push-off portion 62 abuts against support surface 73 of bit shank 71 of bit 70. Actuation of initiator 12.1 causes the piston arranged in cylinder 13 to be extended. That motion is transferred via second piston rod 14 to second positioning member 60, so that it pivots around its end-located mount. Second push-off portion 62 is thereby pushed against support surface 73 of the bit with the result that bit shank 71 is pushed out of second bit receptacle 42, as described e.g. in the document DE 10 2008 025 071 A1.

Third RFID transponder 102 is associated with base carrier 50, and second RFID transponder 101 with replaceable bit holder 40. Both are depicted schematically, respectively by a dashed-line circle and a solid circle. Detection device 110, as described by way of example with reference to FIG. 3, is arranged on second positioning member 60 in the region of lever 61. That device too is depicted schematically by way of a solid circle. Detection device 110 enables noncontact reading of the data stored in second and third RFID transponders 101, 102.

FIG. 6 is a perspective depiction of adapter 20 of second tool 10 shown in FIG. 5. A collar 15, constituting an end-located termination of second piston rod 14, is visible at the upper end of adapter 20. When adapter 20 is installed, collar 15 is operatively connected to the piston-cylinder system. Upon actuation of initiator 12.1, the piston-cylinder system presses onto collar 15 with the result that second positioning member 60 is actuated and second push-off portion 62 is pressed against bit shank 71. When initiator 12.1 is released, the piston-cylinder system is moved back, piston rod 14 being moved back, by means of a spring element 22 engaging on collar 15, in such a way that second push-off portion 62 is shifted out of second bit receptacle 42 (FIG. 5). Detection device 110 is depicted schematically on second base part 21 of adapter 20. Detection device 110 can be arranged entirely or partly on second base part 21 or, as shown in FIG. 5, on second positioning member 60. Detection device 110 comprises a counting device 113. RFID reading device 111 is furthermore associated with detection device 110. In the present case, detection device 110 also encompasses a memory 114 and a radio interface 112.

The number of bits 70 installed using second tool 10 can be detected with the aid of detection device 110. For that purpose, a count status of counting device 113 is incremented by one upon actuation of initiator 12.1. Once maintenance has been completed, for example when all the worn-out bits 70 of a milling drum 80 have been deinstalled and replaced with new ones, the count status can be transmitted to a higher-order control unit (not shown). This is accomplished in the present case wirelessly via radio interface 112. It is also conceivable, however, to transfer the data stored in memory 114 to the control unit in wire-based fashion, for example via electrical contacts 11 shown in FIG. 5.

The identifier or identifiers arranged on the two-part bit holder system 3 is/are also read out upon actuation of initiator 12.1. The identifiers are embodied in the present case as second and third RFID transponders 101, 102. They are read out in noncontact fashion with the aid of RFID reading device 111. The data are stored in memory 114 and can be transferred to the control device, together with the count status, via radio interface 112.

The invention is not limited to the exemplifying embodiments presented in FIGS. 1 to 6. It can be transferred to any other one-piece or multi-part bit holders 1, 2, 3 and to tools 10, 90 provided for that purpose for changing bits 70.

It is conceivable for a data interface to be associated with detection device 110. The data interface is not shown in the exemplifying embodiments that are depicted. The data interface is designed to transfer data to the identifiers arranged on bit holder systems 1, 2, 3. Data relating to an installed bit 70, or to a point in time at which a bit 70 was changed, can thereby, for example, be transferred to the respective identifier. Those data can also be read out and evaluated at the next bit change.

It is conceivable to increment the count status of counting device 113, upon actuation of initiator 12.1, only when data of at least one identifier can be read out at the same time. This ensures that tool 10, 90 has been placed onto a bit holder system 1, 2, 3 upon initiation of an installation or deinstallation operation. For example, a count status of counting device 113 can be incremented only when an RFID transponder 100, 101, 102 is located within radio range of RFID reading device 111 and can be read out. Inadvertent actuation of initiator 12.1 when a tool 10, 90 is not placed on bit holder system 1, 2, 3 thus does not cause the count status to be incremented. Once the data have been transferred, the count status can be reset and/or the stored data can be deleted.

It is also conceivable for the count status for deinstalled or installed bits 70 to be incremented when detection device 110 has read out an identifier even though an initiator 12.1 has not been actuated. Provision can be made, for example, that the count status is incremented when an RFID transponder 100, 101, 102 arranged on a bit holder 1, 2, 3 or on a bit 70 comes within radio range of an RFID reading device 111, arranged on tool 10, 90, of detection device 110. The data that are read out can be taken into consideration in the context of incrementing of the count status. Provision can be made, for example, that the count status can be modified only once within a predefined time period for an identifier that is read out. This prevents the count status from being modified more than once when an identifier is read out repeatedly, for example if a tool 10, 90 needs to be set in place twice during bit installation.

As described above, information regarding the position of bit holder system 1, 2, 3 on milling drum 80, and/or information for unique identification of bit holder system 1, 2, 3, can be stored in the identifiers, in the present case in RFID transponders 100, 101, 103. Those data are read out by detection device 110 upon actuation of initiator 12.1. Execution of the bit change can be associated with those data and thus with a specific bit holder system 1, 2, 3 on milling drum 80. The frequency with which bit 70 on a specific bit holder system 1, 2, 3 of milling drum 80 has been replaced can thus be detected with the aid of detection device 110, and can be stored in memory 114 and transferred to the higher-order control unit. As described above, the total number of bits 70 replaced can additionally be detected using detection device 110.

Advantageously, detection device 110 is arranged on tool 10, 90. It is accordingly not necessary to arrange a detection device 110, or for example an RFID reading device 111 or barcode reader, on the milling machine. Detection device 110 and RFID reading device 111 or the barcode reader are thereby protected from the severe mechanical stress that exists during operation in a context of placement on the milling machine.

Based on the number of replaced bits 70 ascertained with the aid of tool 10, 90, it is possible to determine the wear behavior of bits 70;

material properties of the substrate being milled;

machine utilization efficiency;

machine utilization costs for a milling job that has been carried out. The exchanged bits 70 can be detected cost-efficiently, with little complexity, using tool 10, 90 according to the present invention. In addition, the position of the replaced bits 70 can also be determined with the aid of the identifiers, for example in the form of RFID transponders 100, 101, 102 that are shown. The wear behavior of bits 70 as a function of their installed position on milling drum 80 can thus be ascertained. To enable this, the respective bit holder system 1, 2, 3 is equipped with at least one identifier, for example in the form of an RFID transponder 100, 101, 102. The identifier can be arranged on a bit holder 30, 40 and/or on a base carrier 50 of the respective bit holder system 1, 2, 3. The identifier is read out by the installation/deinstallation tool (tool 10, 90) respectively upon installation and deinstallation of a bit 70.

On the basis of the data thereby detected, a prognosis can be created regarding the life expectancy of bits 70, and can be taken into consideration when scheduling maintenance intervals and planning the provision of replacement bits. The data can also be used to plan ongoing or future milling jobs. The data can advantageously be stored for that purpose with reference to a particular milling drum type and/or a particular milling machine on which the data were ascertained. The detected data can moreover be combined with further data, for example with a removal performance value (milling volume), with machine parameters with which the milling machine was operated, or with a service location of the milling machine. This can be done in memory 114 itself or in the external memory unit to which the data are transferred.

Advantageously, the identifiers are required only on bit holder system 1, 2, 3 but not on bits 70 themselves. Because of the much longer service life of bit holder systems 1, 2, 3 as compared with bits 70, only a comparatively small number of identifiers is needed as compared with known systems in which, for example, RFID transponders 100, 101, 103 are fastened onto bits 70. It is also conceivable, however, also to equip bits 70, in addition to bit holder systems 1, 2, 3, with identifiers in which, for example, the bit type or the item number of bit 70 can be stored. These identifiers can then also be read out using detection device 110 arranged on tool 10, 90.

Further data can be stored in the associated identifier in addition to the position data and data for identification of a particular bit holder system 1. For example, an item number or an installation date or installation time for bit holder system 1, 2, 3 and/or for a bit 70 can be stored in the identifier.

In accordance with a conceivable variant embodiment that is not shown, several RFID reading devices 111 can be arranged on tool 10, 90. Reliable reading of the identifiers is thereby made possible even under unfavorable installation conditions.

In accordance with a further conceivable variant embodiment of the invention, provision can be made that detection device 110 is embodied, upon actuation of the at least one initiator 12.1, to read out an identifier of bit holder system 1, 2, 3 and compare it with data stored in detection device 110; and that deinstallation of bit 70 using tool 10, 90 is inhibited if the data read out from the identifier do not agree with the stored data. Tool 10, 90 can thus be used only to replace bits 70 on previously stipulated bit holder systems 1, 2, 3. An unauthorized bit change is inhibited.

What is claimed is:

1. A bit holder system for a milling machine, the bit holder system comprising:

a bit holder coupled to a milling drum of the milling machine, the bit holder comprising at least one bit receptacle for detachable fastening of at least one bit thereon;

wherein at least one noncontact machine-readable data medium is arranged as an identifier on or in the bit holder;

the noncontact machine-readable data medium contains information corresponding to a position of the bit holder on the milling drum; and a detection device is configured to read out the information corresponding to the position of the bit holder on the milling drum at least in association with installing or deinstalling of a bit thereon, wherein the position of the at least first bit holder on the milling drum is determined based on the information and the installed or deinstalled bit is correlated with the determined position.

2. The bit holder system of claim 1, wherein the noncontact machine-readable data medium is arranged in a region of the bit holder system which is protected from abrasion.

3. The bit holder system of claim 1, wherein the noncontact machine-readable data medium is an electronic data medium.

4. The bit holder system of claim 3, wherein the electronic data medium is an active or passive RFID transponder.

5. The bit holder system of claim 1, wherein the position of the bit holder comprises a coordinate proceeding in an axial direction of the milling drum and/or a coordinate proceeding in a circumferential direction of the milling drum.

6. The bit holder system of claim 1, wherein the noncontact machine-readable data medium contains information corresponding to a point in time at which a bit held in the bit holder system was installed.

7. The bit holder system of claim 1, wherein the bit holder system comprises a base carrier connected fixedly to the milling drum and a replaceable bit holder detachably connected to the base carrier, and at least one noncontact machine-readable data medium is arranged on or in the base carrier and/or on or in the replaceable bit holder.

8. A method for monitoring a status of replaceable bits and/or bit holders on bit holder systems of a milling drum of a milling machine, the method comprising:

reading out, in noncontact fashion via a detection device, a machine-readable data medium arranged as an identifier on or in at least a first bit holder, wherein the machine-readable data medium contains information corresponding to a position of the at least first bit holder on the milling drum;

determining the position of the at least first bit holder on the milling drum based on the information associated with the machine-readable data medium;

comparing the data read out from the identifier with data stored in the detection device for the position on the milling drum; and detecting that a replaceable bit at that position has been changed.

9. The method of claim 8, wherein the position of the at least first bit holder on the milling drum is determined by the detection device.

10. The method of claim 8, further comprising:

transferring the information associated with the machine-readable medium and read out by the detection device to a control unit via an interface between the detection device and the control unit, wherein the position of the at least first bit holder on the milling drum is determined by the control unit.

11. The method of claim 8, wherein the detection device comprises an RFID reading device and the machine-readable data medium is an active or passive RFID transponder.

12. The method of claim 8, further comprising determining, based on the information associated with the machine-readable data medium, a point in time at which a bit held in the at least first bit holder was installed.

13. The method of claim 12, further comprising storing information read out from the machine-readable data medium, and/or points in time at which the machine-readable data medium was read out, in a memory associated with the detection device.

14. The method of claim 8, further comprising transferring data to the identifier of the at least first bit holder via an interface associated with the detection device, wherein the transferred data corresponds to a point in time at which a bit was installed on at least first bit holder.

15. A method for monitoring a status of replaceable bits and/or bit holders on bit holder systems of a milling drum of a milling machine, the method comprising:

reading out, in noncontact fashion via a detection device, a machine-readable data medium arranged as an identifier on or in at least a first bit holder, wherein the machine-readable data medium contains information corresponding to a position of the at least first bit holder on the milling drum;

determining the position of the at least first bit holder on the milling drum based on the information associated with the machine-readable data medium; and deinstalling the bits from the bit holder system with the aid of a tool comprising the detection device, and/or installing the bit on the bit holder system with the aid of the tool;

wherein the position of the at least first bit holder on the milling drum is determined based on the information associated with the machine-readable data medium and the installed or deinstalled bit is correlated with the determined position.

16. The method of claim 15, wherein the position of the at least first bit holder on the milling drum is determined by the detection device.

17. The method of claim 15, further comprising:

transferring the information associated with the machine-readable medium and read out by the detection device to a control unit via an interface between the detection device and the control unit, wherein the position of the at least first bit holder on the milling drum is determined by the control unit.

18. The method of claim 15, further comprising determining, based on the information associated with the machine-readable data medium, a point in time at which a bit held in the at least first bit holder was installed.

19. The method of claim 18, further comprising storing information read out from the machine-readable data medium, and/or points in time at which the machine-readable data medium was read out, in a memory associated with the detection device.

20. The method of claim 15, further comprising transferring data to the identifier of the at least first bit holder via an interface associated with the detection device, wherein the transferred data corresponds to a point in time at which a bit was installed on at least first bit holder.

* * * * *